United States Patent [19]

Honsa

[11] Patent Number: 4,771,833

[45] Date of Patent: Sep. 20, 1988

[54] PORTABLE TOOL WITH VIBRATION DAMPING

[75] Inventor: Thomas S. Honsa, Moline, Ill.

[73] Assignee: Honsa Technologies, Moline, Ill.

[21] Appl. No.: 153,684

[22] Filed: Feb. 8, 1988

[51] Int. Cl.[4] ..... B25F 5/00

[52] U.S. Cl. ..... 173/162.2; 16/110 R

[58] Field of Search ..... 173/162.1, 162.2; 16/110 R; 81/489

[56] References Cited

U.S. PATENT DOCUMENTS 2,019,964 11/1935 Hamerly ..... 173/162.2
2,035,643 3/1936 Douglass et al. ..... 173/162.2
3,485,307 12/1969 Riley, Jr. et al. ..... 173/162.1 X
4,648,468 3/1987 Honsa ..... 173/162.2 X

*Primary Examiner*—Frank T. Yost
*Assistant Examiner*—James L. Wolfe
*Attorney, Agent, or Firm*—Henderson & Sturm

[57] ABSTRACT

A portable tool of the basic type generating vibration during operation is improved by the provision of a hollow insert into the cavity or space of the handle that is filled with shock-absorbent material. The insert opens at the front of the handle and is internally threaded to receive the externally threaded rear part of the barrel, for example, of an accessory or attachment, such as a chipper, chisel or the like. A separable lock is provided for preventing accidental unscrewing of the barrel.

12 Claims, 2 Drawing Sheets

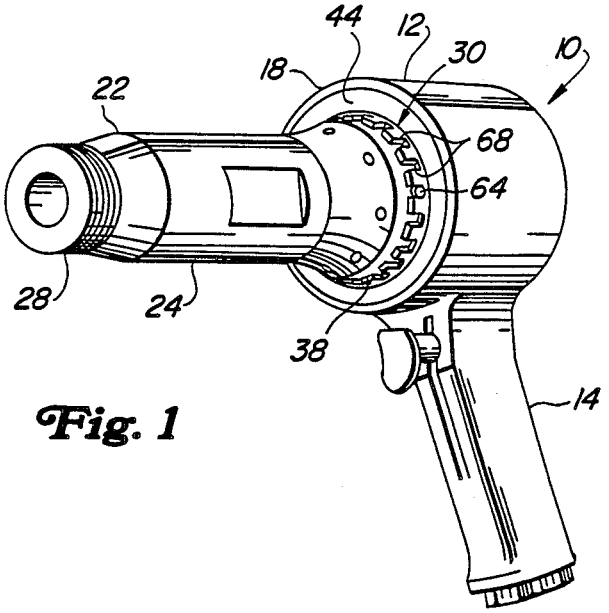
Fig. 1
Fig. 2
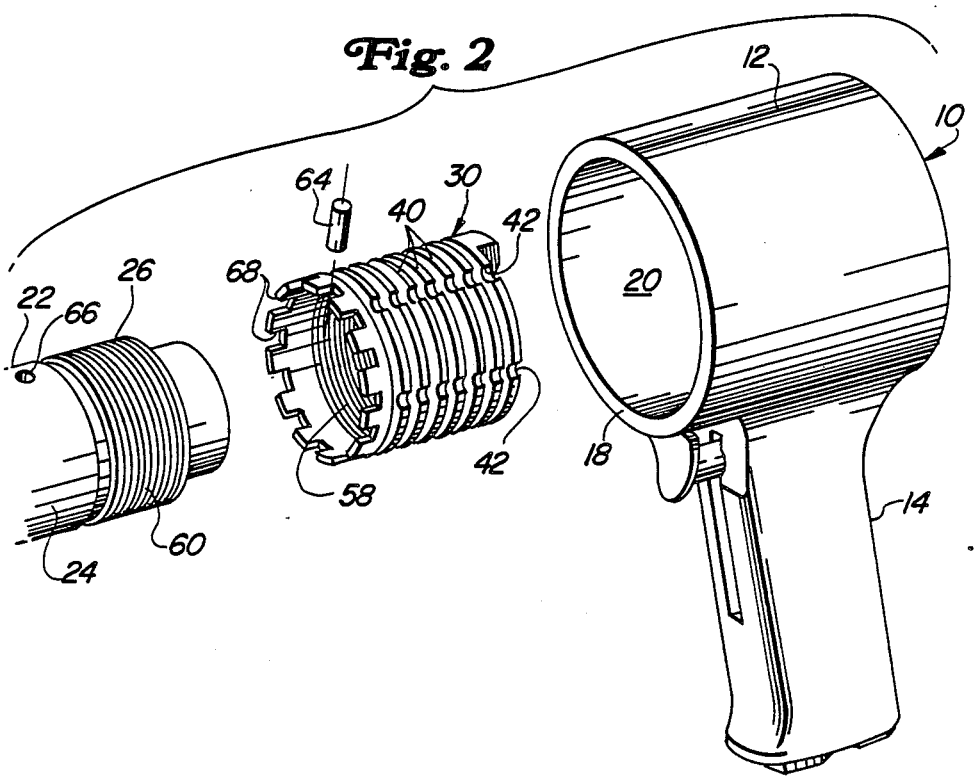

PORTABLE TOOL WITH VIBRATION DAMPING

BACKGROUND AND SUMMARY OF THE INVENTION

The subject matter of U.S. Pat. No. 4,648,468, issued Mar. 10, 1987, is a portable, powered hand-held tool in which vibrations generated during operation are cushioned by the provision of embedding the barrel of a chipper, chisel, etc., in shock-absorbent material contained within a cavity that has a rigid wall forming an integral part of the rigid handle, whereby shock forces are materially isolated from the handle and thus from the user of the tool. In the patented structure, the barrel per se is adhered to the handle via the absorbent material, an assembly procedure that requries a certain amount of care and precision in assuring proper positioning of the barrel in the handle cavity.

The present invention provides an improvement over the patented structure by utilizing a hollow insert member within the cavity and surrounded by and adhered to the cavity wall by the absorbent material. The hollow member opens coaxially at the front of the handle and becomes available for receiving the barrel of the chisel. chipper, etc. Specifically, the interior of the hollow member is threaded to receive the externally threaded rear part of the barrel. The barrel is operative as a unit with the handle but becomes a separable rather than a captive part of the handle and has the advantage of enabling the interchangeability of various barrels with one handle, thus increasing the overall flexibility and utility of the tool. This feature also enables the provision of basic handles respectively provided with inserts or hollow members of various sizes for receiving barrels of various sizes. Still further, the relatively light-weight hollow member is easier to assemble to the handle and thus makes for more efficient and lower-cost manufacture.

Features in additon to or by way of further explanation of the foregoing will become apparent as a preferred embodiment of the invention is disclosed in the ensuing description and accompanying drawings.

DESCRIPTION OF THE DRAWINGS

FIG. 1 is a perspective of a representative tool assembly of handle and associated barrel.

FIG. 2 is an exploded perspective showing the basic parts involved.

DETAILED DESCRIPTION OF A PREFERRED EMBODIMENT OF THE INVENTION

Figure 3:
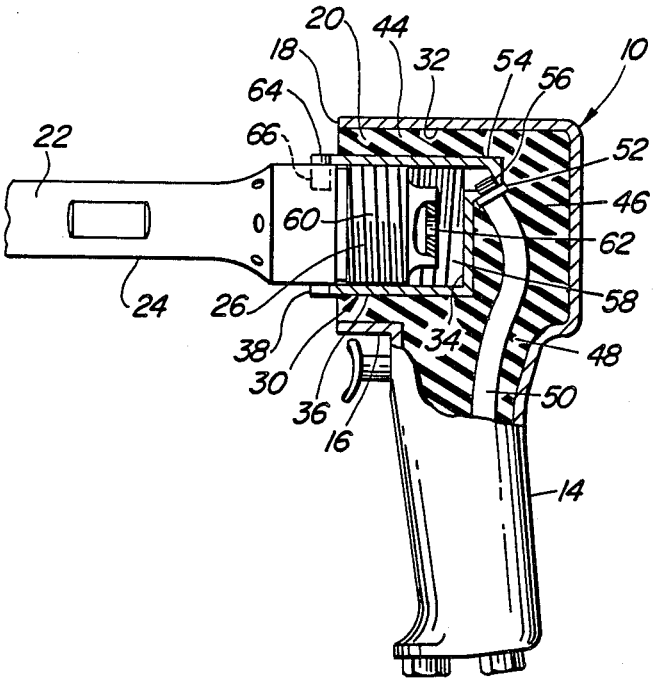
FIG. 3 is a longitudinal section through the assembly.
Figure 4:
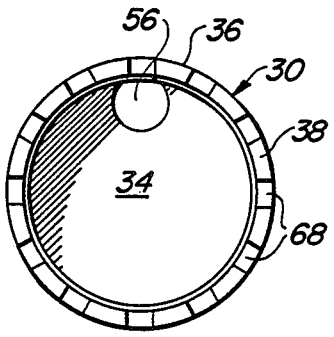
FIG. 4 is a front view of the hollow insert member.
Figure 5:
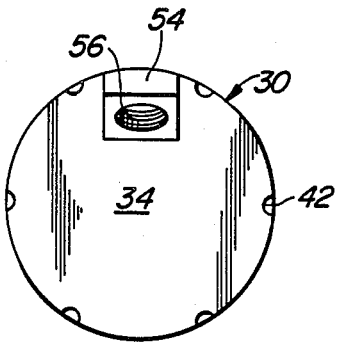
FIG. 5 is a rear view of the hollow insert member.

Reference is directed to the above-noted U.S. patent for the background of the basic principles involved in the design in which the handle or gun portion of the tool is virtually isolated from the vibrations and related forces generated during use of the handle with an accessory of the fluid-powered type. In the present case, as in the patent, familiarity with the general operation of fluid-powered and like tools is assumed. It is to be further understood that the disclosure of a preferred embodiment is representative and not restrictive.

The assembled tool and accessory best appear in FIG. 1 as comprising a handle (10) configured here as a "gun" having a main body (12) and associated trigger-equipped grip (14), the two being integrally formed of rigid material such as light-weight steel, aluminum, etc. Now, having reference to the usual position or status of the tool in operation, which is essentially horizontal as respects the body (12) and generally upright as respects the grip (14), the body is seen as being in the form of a cylinder on a fore-and-aft axis and as having a cylindrical wall (16) opening at its front as a circular rim or edge (18) and defining a cavity (20). The accessory, denoted at (22), may be of any known character and typically includes a barrel (24) having a rear cylindrical part (26) and a fore part such as a chuck (28) for receiving an implement such as a chisel, chipper or the like (not shown). In the assembled structure, the accessory and handle wall (16) are coaxial.

As observed in the above-identified patent, the rear part of the barrel is disposed within the handle cavity and retained therein by the shock-absorbent material, in which case the accessory, or at least its rear portion, is captive in the cavity. According to the present invention, however, the arrangement between the handle and accessory is such that the accessory is removably carried by the handle, albeit functioning as an operational part of the handle in working mode.

The inventive improvement structure resides primarily in the use of a cylindrical insert of hollow member (30) having an outside diameter smaller than the insider diameter of the cylindrical wall (12) so that the insert is receivable within the cavity (20) in such fashion as to provide an annular space (32). The insert is of rigid material, such as steel, and is preferably configured as a cup having a rear radial end wall (34) and an annular wall (36) that opens at its front as an annulus or rim (38). The outer surface of the cylindrical wall of the insert is provided with several gooves (40) that run angularly of the wall and further grooves (42) that run lengthwise of the wall. These grooves improve the adhesion of the insert to the interior surface of the handle wall (16) when the insert is positioned within the cavity and the annular space (32) existing between the outside of the insert and the inside of the wall (16) is filled with shock-absorbent material (44), which may be of the type disclosed in the above-noted patent. Also, as shown in that patent, the material (44) occupies spaces (46) and (48) contiguous with and behind and below the insert, save for a fluid supply tube or conduit (50) embraced by the material (44), which tube is connectable to any typical external power source (not shown). The inner part of the tube is connected by a suitable fitting (52) to the rear wall (34) of the cylindrical insert (30), the wall having a thickened rear portion (54) provided with a bore (56) that leads to the interior of the insert for purposes to appear presently.

The insert is accurately positioned within the cavity so that the insert is coaxial with the cylindrical wall (16) on the foresaid fore-and-aft axis, a procedure that may be accomplished by the use of appropriate jigs, fixtures, etc. (not shown, because of the wide variety of assists that could be employed). Suffice it to say that the properly positioned insert or hollow member (30) becomes a vibration-isolated adjunct to the handle and is retained therein by the shock-absorbent material as explained above. When so positioned, the insert opens forwardly at its annulus or rim (38) in position to receive and form a positive connection with the rear part of the accessory barrel (24).

The connection between the barrel and insert is achieve by means securing the two together for operational functioning as a unit. The rear part of the barrel and the interior of the insert are of comparable diameters, and the preferred means comprises internal threads (58) within the insert and mating external threads (60) on the rear part of the barrel. The threads are relatively fine so as to establish a fluid-tight joint between the insert and barrle, since the interior mechanism (not shown) of the barrel is fluid-operated, as is well known to those versed in the art, useful, for example, in reciprocating a chipper, chisel, etc., (not shown) chucked in the barrel fore part. Fluid under pressure via the supply conduit or tube (50) and fitting (52) reaches the interior of the barrel via an inlet port (62) at the rear of the barrel (FIG. 3).

The barrel is tightly screwed into the insert and is prevented from accidental unscrewing by anti-reverse lock means, here provided by the insertion of a removable locking pin (64) through a small radial hole or bore (66) in the barrel rear part (26) and into a registering notch (68) in the insert rim (38), the latter being castellated for the purpose of providing several notches for selective fore-and-aft register with the hole (66) after tightening of the barrel into the insert (30).

The barrel may be easily removed from the handle by removal of the lock pin (64) and unscrewing of the barrel, as for repairs to or replacement of the accessory. This is a distinct advantage over the patented design, since separation of the accessory from the handle becomes important in circumstances just descirbed, besides which manufacture of the handle and insert is facilitated and costs reduced because of the relative ease with which the insert may be assembled to the handle. Further, the handle, equipped with the insert (30), may be sold separately for use with existing accessories manufactured to fit the insert.

Features and advantages of the invention, other than those pointed out herein, will become apparent to those versed in the art, as will many modifications in the preferred embodiment disclosed, all without departure from the spirit and scope of the invention.

I claim:

1. A portable, powered hand-held tool of the type generating vibration during operation and having a rigid handle associated with a separate, rigid fore-and-aft barrel including a rear part adjacent to the handle and wherein the handle has a fore part providing a rigid, generally cylindrical wall coaxial with the barrel and defining a cavity having a front opening, characterized in a hollow cylindrical member of rigid material is coaxially disposed within the cavity and opens at its front end at the cavity opening and further has an annular wall having an outer surface of a diameter less than that of the handle wall and combining with the handle wall to provide an annular space, said hollow member wall further having an inner surface of a diameter on the order of that of the rear part of the barrel, a filling of shock-absorbing material is contained within said annular space and locks the hollow member to and within the handle wall, the rear part of the barrel is axially receivable within the hollow member, and disengageable securing means is cooperative between the barrel rear part and the inner wall of the hollow member for holding said part and member together in fluid-tight relationship.

2. The tool of claim 1, in which the hollow member is cup-like and has a rear radial wall combining with interior portions of the handle other than the wall of the fore part of the handle to provide a further space contiguous with the annular space and receivable of a further quantity of shock-absorbing elastomer material.

3. The tool of claim 2, in which the radial wall has a through opening for reciving a fluid supply tube.

4. The tool of claim 3, in which a fluid supply tube is contained within the handle.

5. The tool of claim 1, further characterized in that the outer wall surface of the hollow member is provided with means for improving the adherence of the shock-absorbing material thereto.

6. The tool of claim 5, in which said means comprises a plurality of grooves in said outer wall of the hollow member.

7. The tool of claim 6, in which the grooves extend both angularly and lengthwise of said wall.

8. The tool of claim 1, in which the securing means between the barrel and hollow member comprises cooperative elements engageable and disengageable upon rotation and reverse rotation, respectively, of the barrel relative to the hollow member.

9. The tool of claim 8, in which the elements are internal threads in the hollow member and mating external threads on the rear part of the barrel.

10. The tool of claim 9, including lock means cooperative between the rear part of the barrel and the front part of the hollow member for preventing unthreading of the barrel from the hollow member.

11. The tool of claim 10, in which the lock means includes an opening in the barrel exposed exteriorily of the barrel, the front part of the hollow member has a plurality of angularly spaced notches with at least one of which the barrel opening is registrable upon screwing the barrel into the hollow member, and a pin is inserted into the registering notch and opening.

12. The tool of claim 11, in which the front part of the hollow member is castellated to provide the notches.

* * * * *